US009161586B2

(12) United States Patent
Brown

(10) Patent No.: US 9,161,586 B2
(45) Date of Patent: Oct. 20, 2015

(54) MAGNETIC MOUNTING CLIP AND RELATED METHOD OF USE

(75) Inventor: Kenneth J. Brown, West Chester, PA (US)

(73) Assignee: MSB INCORPORATED, Glenmoore, PA (US)

( * ) Notice: Subject to any disclaimer, the term of this patent is extended or adjusted under 35 U.S.C. 154(b) by 666 days.

(21) Appl. No.: 13/458,248

(22) Filed: Apr. 27, 2012

(65) Prior Publication Data

US 2012/0212968 A1 Aug. 23, 2012

Related U.S. Application Data

(63) Continuation-in-part of application No. 12/763,269, filed on Apr. 20, 2010, now Pat. No. 8,545,041, which is a continuation-in-part of application No. 11/754,443, filed on May 29, 2007, now Pat. No. 7,703,938, and a continuation-in-part of application No. 11/311,296, filed on Dec. 19, 2005, now abandoned.

(60) Provisional application No. 60/636,905, filed on Dec. 18, 2004.

(51) Int. Cl.

| | |
|---|---|
| ***F21V 21/088*** | (2006.01) |
| ***A42B 1/24*** | (2006.01) |
| ***F21V 21/096*** | (2006.01) |

(52) U.S. Cl.

CPC . *A42B 1/24* (2013.01); *A42B 1/244* (2013.01); *F21V 21/0885* (2013.01); *F21V 21/0965* (2013.01); *Y10T 29/49826* (2015.01)

(58) Field of Classification Search

CPC ... F21V 21/0885; F21V 21/0965; A42B 1/24; A42B 1/244; Y10T 29/49826

USPC ..... 362/103, 106, 190, 191, 396, 398

See application file for complete search history.

(56) References Cited

U.S. PATENT DOCUMENTS

| | | | |
|---|---|---|---|
| 1,858,284 | A | 5/1932 | Schwartz |
| 2,402,877 | A | 6/1946 | Dial |
| 4,097,012 | A | 6/1978 | McIntyre |
| 4,390,927 | A | 6/1983 | Von Feldt |
| 4,406,040 | A | 9/1983 | Cannone |
| D281,393 | S | 11/1985 | Karnhag et al. |
| 5,086,958 | A | 2/1992 | Nagy |
| 5,103,384 | A | 4/1992 | Drohan |
| 5,199,780 | A | 4/1993 | Ekman |
| 5,274,885 | A | 1/1994 | Hellweg |
| 5,484,066 | A | 1/1996 | Luisi |
| 5,568,549 | A | 10/1996 | Wang |
| 5,593,124 | A | 1/1997 | Wang |
| 5,620,120 | A | 4/1997 | Tien |
| 5,683,171 | A | 11/1997 | Van Gennep |
| 5,690,416 | A | 11/1997 | Van Gennep |
| 5,772,166 | A | 6/1998 | Adams |
| D401,005 | S | 11/1998 | Ludbrook et al. |

(Continued)

*Primary Examiner* — Thomas M Sember

(74) *Attorney, Agent, or Firm* — Allen Dyer Doppelt Milbrath & Gilchrist

(57) ABSTRACT

A mounting clip for attaching objects, such as flashlights to an article, includes a clipping portion dimensioned for attaching the clip to the article and an object mounting portion formed with the clipping portion. Objects of different widths are removably yet snugly grasped within the object mounting portion. The clipping portion includes upper and lower members defining a slot for receiving the article through a lip of the slot and frictionally securing the clip to the article.

26 Claims, 16 Drawing Sheets

(56) References Cited

U.S. PATENT DOCUMENTS

| | | | |
|---|---|---|---|
| 5,867,874 | A | 2/1999 | Simpson |
| 5,979,724 | A | 11/1999 | Loewenthal, Jr. et al. |
| 6,036,071 | A | 3/2000 | Hartmann et al. |
| 6,206,543 | B1 | 3/2001 | Henry |
| 6,371,345 | B1 | 4/2002 | Leyden et al. |
| D464,750 | S | 10/2002 | Cooper |
| 6,491,194 | B2 | 12/2002 | Marvin |
| 6,564,432 | B1 | 5/2003 | Kushner |
| 7,040,783 | B1 | 5/2006 | Christianson |
| 7,055,979 | B2 | 6/2006 | Lee |
| 7,099,466 | B2 | 8/2006 | Walsh |
| 7,099,467 | B1 | 8/2006 | Rohrback |
| 7,168,821 | B2 | 1/2007 | Huang |
| D544,476 | S | 6/2007 | Wilson et al. |
| D550,450 | S | 9/2007 | Dong |
| D578,508 | S | 10/2008 | Wang |
| D587,683 | S | 3/2009 | Ham et al. |
| D587,684 | S | 3/2009 | Ham et al. |
| D589,031 | S | 3/2009 | Bentley et al. |
| D589,492 | S | 3/2009 | Mistry |
| D593,998 | S | 6/2009 | Bentley et al. |
| D601,134 | S | 9/2009 | Elabidi et al. |
| D601,543 | S | 10/2009 | Bentley |
| D602,001 | S | 10/2009 | Bentley |
| D602,008 | S | 10/2009 | Bentley et al. |
| D617,316 | S | 6/2010 | Elabidi et al. |
| 2004/0040994 | A1 | 3/2004 | Parcelles |
| 2005/0254238 | A1 | 11/2005 | Parker et al. |
| 2009/0273316 | A1 | 11/2009 | Lee |
| 2010/0008528 | A1 | 1/2010 | Isvan |
| 2010/0020998 | A1 | 1/2010 | Brown et al. |
| 2010/0137038 | A1 | 6/2010 | Scholz et al. |
| 2011/0222274 | A1* | 9/2011 | Ko et al. ..... 362/191 |

* cited by examiner

MAGNETIC MOUNTING CLIP AND RELATED METHOD OF USE

CROSS-REFERENCE TO RELATED APPLICATIONS

This application is a continuation-in-part of pending U.S. patent application Ser. No. 12/763,269, filed on Apr. 20, 2010, entitled "Mounting Clip," which is a continuation-in-part of U.S. patent application Ser. No. 11/754,443, filed on May 29, 2007, now U.S. Pat. No. 7,703,938, entitled "Flashlight Mounting Clip," which is a continuation-in-part of U.S. patent application Ser. No. 11/311,296, filed on Dec. 19, 2005, entitled "Flashlight Hat Clip", now abandoned, which claims priority to U.S. Provisional Application No. 60/636,905, filed Dec. 18, 2004, entitled "Flashlight Hat Clip," the disclosures of which are hereby incorporated by reference herein in their entireties, and are all commonly owned.

FIELD OF THE INVENTION

This invention relates to a mounting clip that can be detachably mounted on articles, hung from a hook, and magnetically attached to ferrous surfaces to temporarily mount a flashlight or similarly shaped item thereto and related methods of use.

BACKGROUND OF THE INVENTION

Flashlights have long been popular as portable light sources and can provide a lightweight, compact package for casting a beam of light. More modern flashlight configurations utilize a light emitting diode that provides a strong light beam from relatively small batteries carried in the flashlight casing. Generally, these mini-flashlights are not self-supporting. Thus, it is typically necessary for a user of these mini-flashlights to use one hand to hold and position the light beam emanating from the flashlight, which can be a hindrance if the user is trying to accomplish a task that requires the use of more than one hand.

Accordingly, it would be desirable to provide a mounting clip that is independent of the flashlight and that can be mounted to the bill of a cap along the side of the head to direct a beam of light forwardly of the user to free the use of both hands of the user for other activities. It would further be desirable to provide a mounting clip that can be used with multiple sizes of mini-flashlights. It is also desirable to provide a mounting clip having the option to hang the clip from a hook or mount the clip to a ferrous surface.

SUMMARY OF THE INVENTION

The invention contemplates a clip for attaching objects to an article. The clip has a clipping portion that has both an upper member and a lower member. These members have opposing surfaces that define a slot therebetween. This slot receives an article such as the bill of a baseball cap. The clipping portion is dimensioned for frictionally attaching to the article.

An object mounting portion is formed with the clipping portion. The clipping portion is oriented in a first direction and the object mounting portion is oriented so that an object having an elongate portion (such as a flashlight) has the elongate portion extending generally orthogonally with respect to the first direction when the object is secured by the object mounting portion.

Means are provided for removably and snugly grasping objects of different width dimensions. A segment of the grasping means comprises a portion of the upper member of the clipping portion. The grasping means also comprises a first opposing segment of the object mounting portion that is biased toward the clipping portion so as to exert a gripping force on an object carried therebetween.

Additionally, a removably attachable magnet is attached to the clipping portion for the purpose of attaching the clip to a ferrous surface.

In a separate embodiment, a slide removably engages the clipping portion, and the magnet is attached to the slide. The slide has a recess having a size and dimension to capture and store the removable hook between the slide and the clipping portion. A detent is molded on the clipping portion that engages the slide so that the slide engages and removably attaches to the clipping portion.

A hanging region defines an aperture proximate the clipping portion. The aperture has a size and dimension to receive a removable hook in order to hang the clip. The hook has a clip-engaging region and a surface-engaging region and can engage the aperture with the clip-engaging region. At the same time, the hook can engage a hookable surface with the surface-engaging region.

The invention also contemplates a method of hanging an object comprising the steps of a) providing a clip comprising a clipping portion dimensioned for removably attaching to an article, wherein at least one magnet is attached to the clipping portion, wherein an aperture is proximate the clipping portion, the aperture having a size and dimension to receive a removable hook; b) providing a hook comprising a clip-engaging region and a surface-engaging region, the hook having a size and dimension to engage the aperture with the clip-engaging region and concurrently engage a hookable surface with the surface-engaging region; c) engaging the aperture with the clip-engaging region of the hook; d) engaging a hookable surface with the surface-engaging region of the hook; and e) attaching an object to the clip.

Additionally, the invention contemplates a method of aiming a flashlight comprising the steps of a) providing a clip having a clipping portion dimensioned for removably attaching to an article, wherein at least one magnet attached to the clipping portion, wherein the clip comprises an object mounting portion; b) attaching a flashlight to the magnet; c) positioning the object mounting portion to rest on a surface; and d) positioning the flashlight at an angle so that when the flashlight is on, light emitted from the flashlight illuminates a target.

BRIEF DESCRIPTION OF THE DRAWINGS

The advantages of this invention will become apparent upon consideration of the following detailed disclosure of the invention, especially when taken in conjunction with the accompanying drawings wherein.

DETAILED DESCRIPTION OF THE EMBODIMENTS

The present invention will now be described more fully hereinafter with reference to the accompanying drawings, in which embodiments of the invention are shown. This invention may, however, be embodied in many different forms and should not be construed as limited to the embodiments set forth herein. Rather, the embodiments herein presented are provided so that this disclosure will be thorough and complete, and will fully convey the scope of the invention to those skilled in the art.

Figure 1:
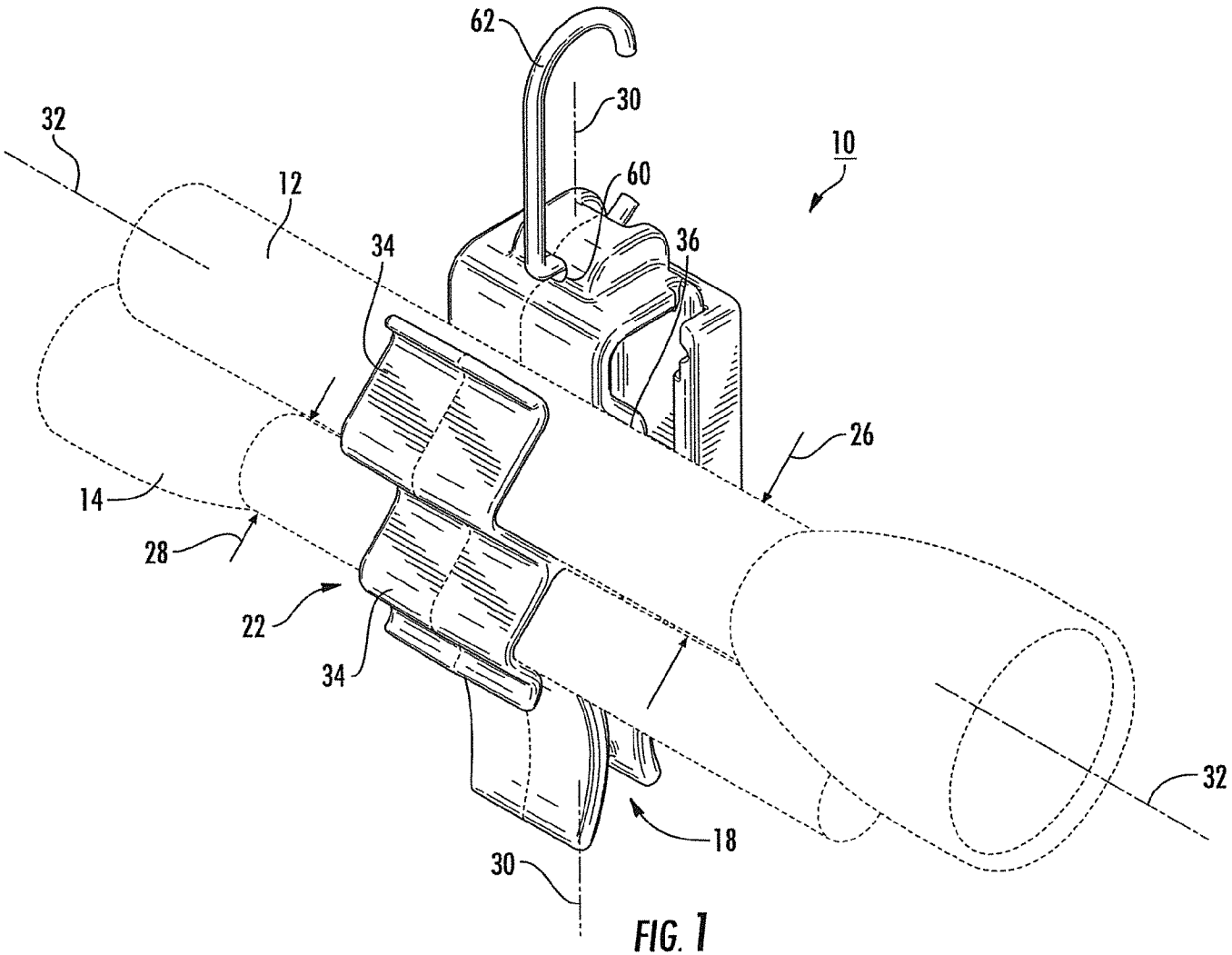
FIG. 1 is a perspective view of one embodiment of the invention illustrating its use in carrying flashlights, by way of example.
Figure 2:
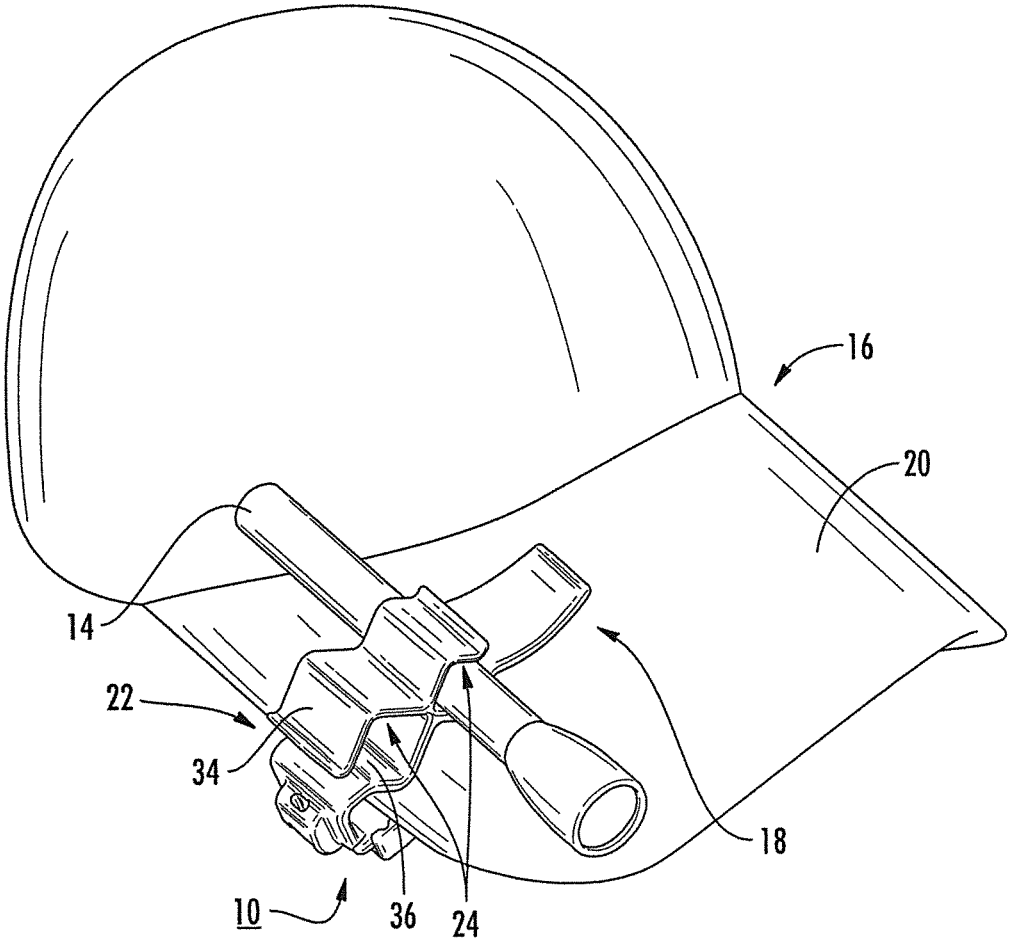
FIG. 2 is a perspective view of the invention illustrated in FIG. 1 with the invention clipped on a representative baseball cap.

With reference initially to FIGS. 1 and 2, one embodiment of the invention is herein described as a clip 10 for attaching objects 12, 14 to an article 16. With continued reference to FIGS. 1 and 2, and to FIGS. 3 and 4, embodiments of the clip 10 comprise a clipping portion 18 dimensioned for removably attaching to the article 16, such as a visor or bill 20 of the article 16, herein a baseball cap by way of example. Object mounting portion 22 is formed with the clipping portion 18 and grasping means 24 is formed with the object mounting portion 22 for removably and snugly grasping the objects 12, 14 of different width dimensions 26, 28 within the object mounting portion.

With continued reference to FIG. 1, by way of example, the clipping portion 18 is oriented in a first direction 30 and the object mounting portion 22 is oriented so that the object has its elongate axis 32 extending generally orthogonally with respect to the first direction when the object 12, 14 is carried by the object mounting portion 22. The grasping means 24 comprises opposing segments 34, 36 biased toward each other so as to exert a gripping force on the objects 12, 14 carried therebetween.

Figure 3:
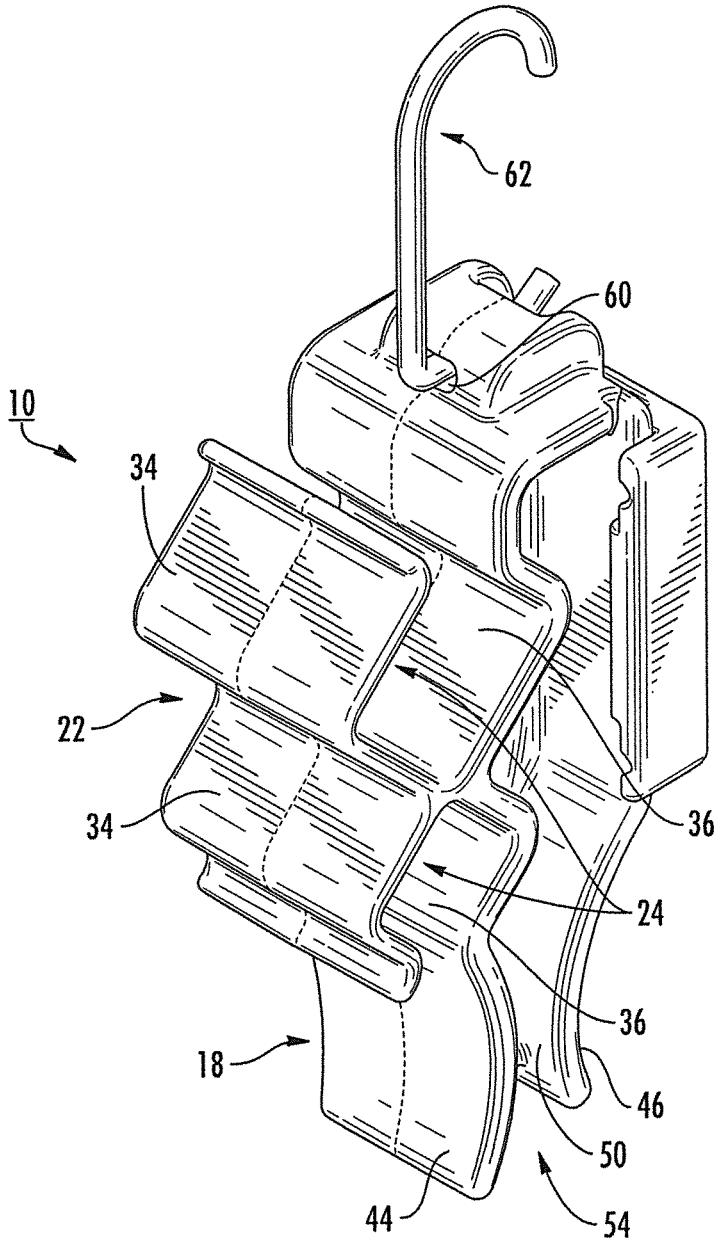
FIG. 3 is a perspective of the invention illustrated in FIGS. 1 and 2.
Figure 4:
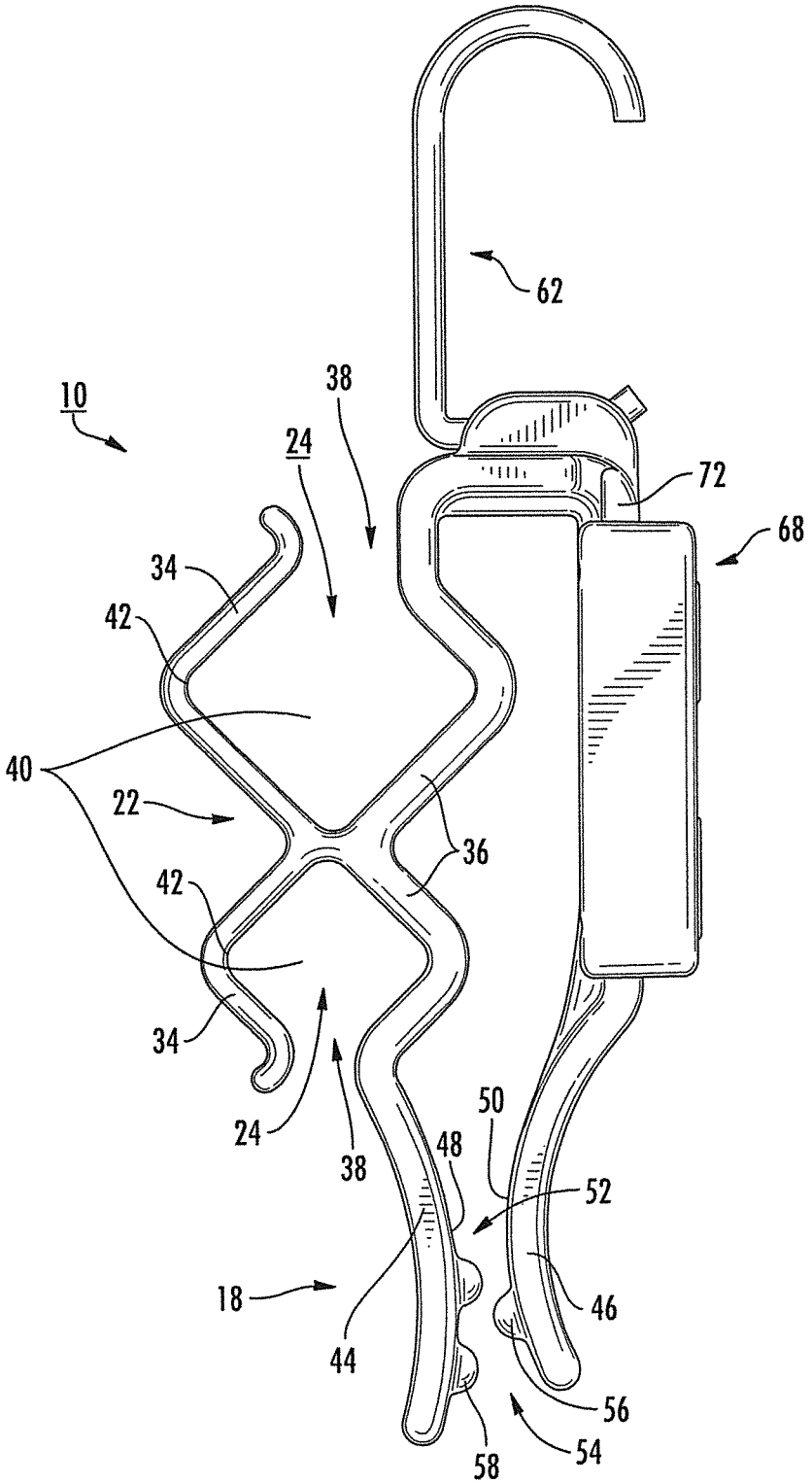
FIG. 4 is side view of the invention illustrated in FIG. 1-3.

With continued reference to FIG. 3 and now to FIG. 4, the opposing segments 34, 36 are dimensioned to form openings 38 therebetween, wherein at least one of the opposing segments 24, 36 can flex sufficiently away from the other to expand the size of the opening 38 for permitting the objects 12, 14 to enter the grasping means 24 through an expanded opening.

By way of further example with continued reference to FIGS. 3 and 4, embodiments of the invention may comprise the clip 10 having each of the opposing segments 34, 36 including grasping means 24 having a substantially square or rectangular aperture 40. The corners of the aperture, in one embodiment, comprise radiused or arcuate segments 42.

As illustrated with reference again to FIG. 4, by way of example for each embodiment herein described, the clipping portion 18 is herein described as including an upper member 44 and a lower member 46 having opposing surfaces 48, 50 defining a slot 52 therebetween for receiving the article 16, as illustrated with reference again to FIG. 2, through the slot 52 and frictionally securing the article in the slot 52.

Embodiments of the invention include the upper member 44 of the clipping portion 18 forming at least part of the second segment 36 of the object mounting portion 22, as illustrated with reference again to FIGS. 1 trough 4. Yet further as described with continued reference to FIGS. 3 and 4, the opposing surfaces 48, 50 comprise arcuate portions. Yet further, as illustrated in FIG. 4, by way of example, the opposing surfaces 48, 50 may have a convex surface opposing a concave surface.

By way of example with reference again to FIGS. 3 and 4, the upper and lower members 44, 46 comprise a lip 54 of the clipping portion 18, wherein the lip is flared for increasing an entrance dimension to the slot 52. At least one protuberance 56 extends from at least one of the opposing surfaces 48, 50, as illustrated with reference to FIG. 4, wherein the protuberance is proximate the lip 54. Yet further, embodiments may comprise the protuberance 56 on one of the opposing surfaces 48, 50 and two protuberances 58 on the other opposing surface for cooperating therewith so as to enhance a frictional contact with the article secured therebetween.

Figure 5:
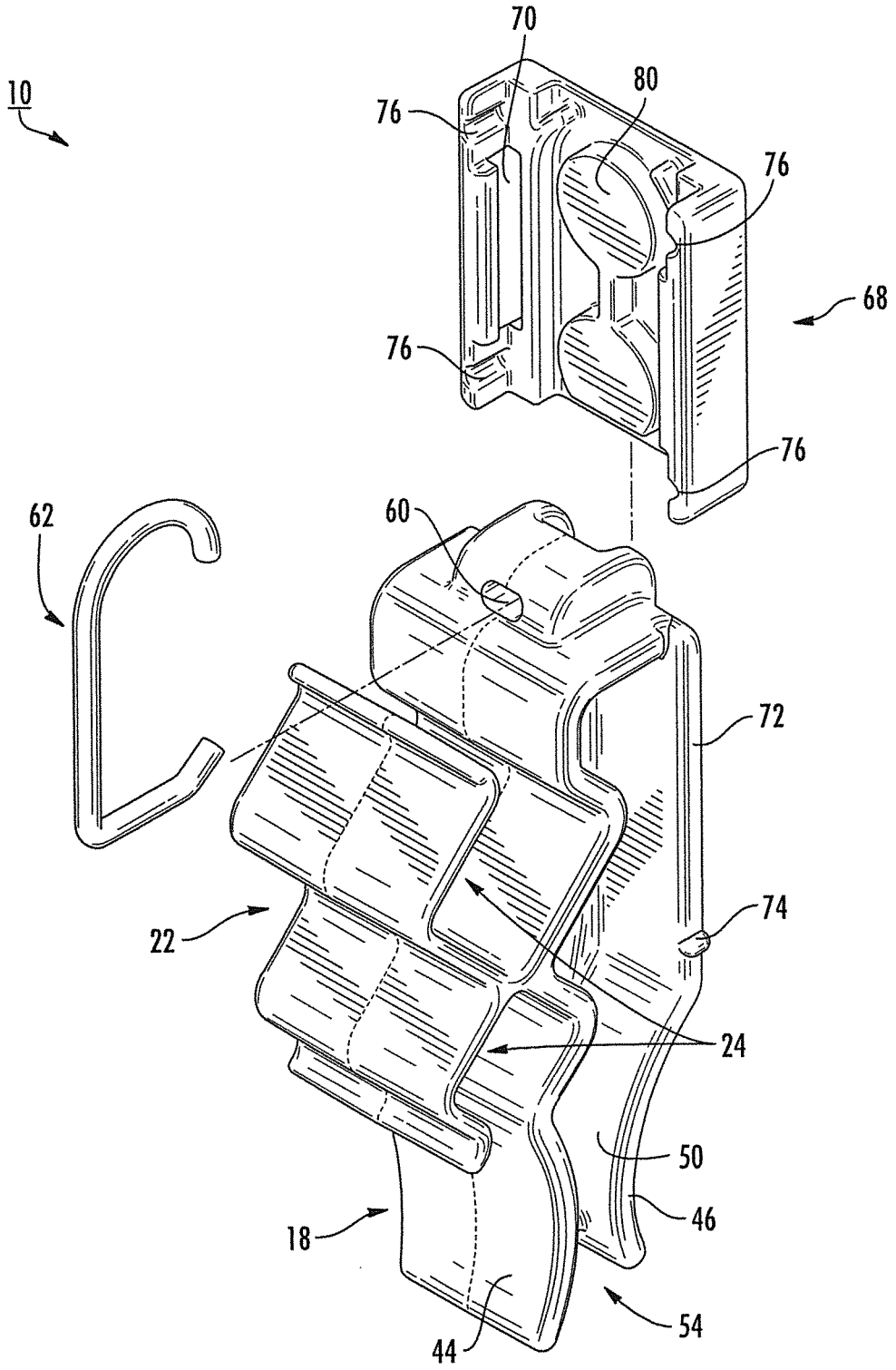
FIG. 5 is a exploded perspective of the invention like FIG. 3.

Yet further, and with reference again to FIGS. 1-3 and also to FIG. 5, by way of example, embodiments include the clip 10 having hole 60 for passing a line or hook 62 therethrough.

Generally, the clip 10 is formed of a plastic, although other materials, such as nylon, steel and other durable materials could be used as well. Furthermore, the configuration of the clip 10 is particularly adapted to being formed by injection molding. The opposing surfaces 48, 50 of clipping portion 18 may be covered with a rubber-like or soft plastic coating to enhance the gripping of the clipping portion onto the article 16.

Figure 6:
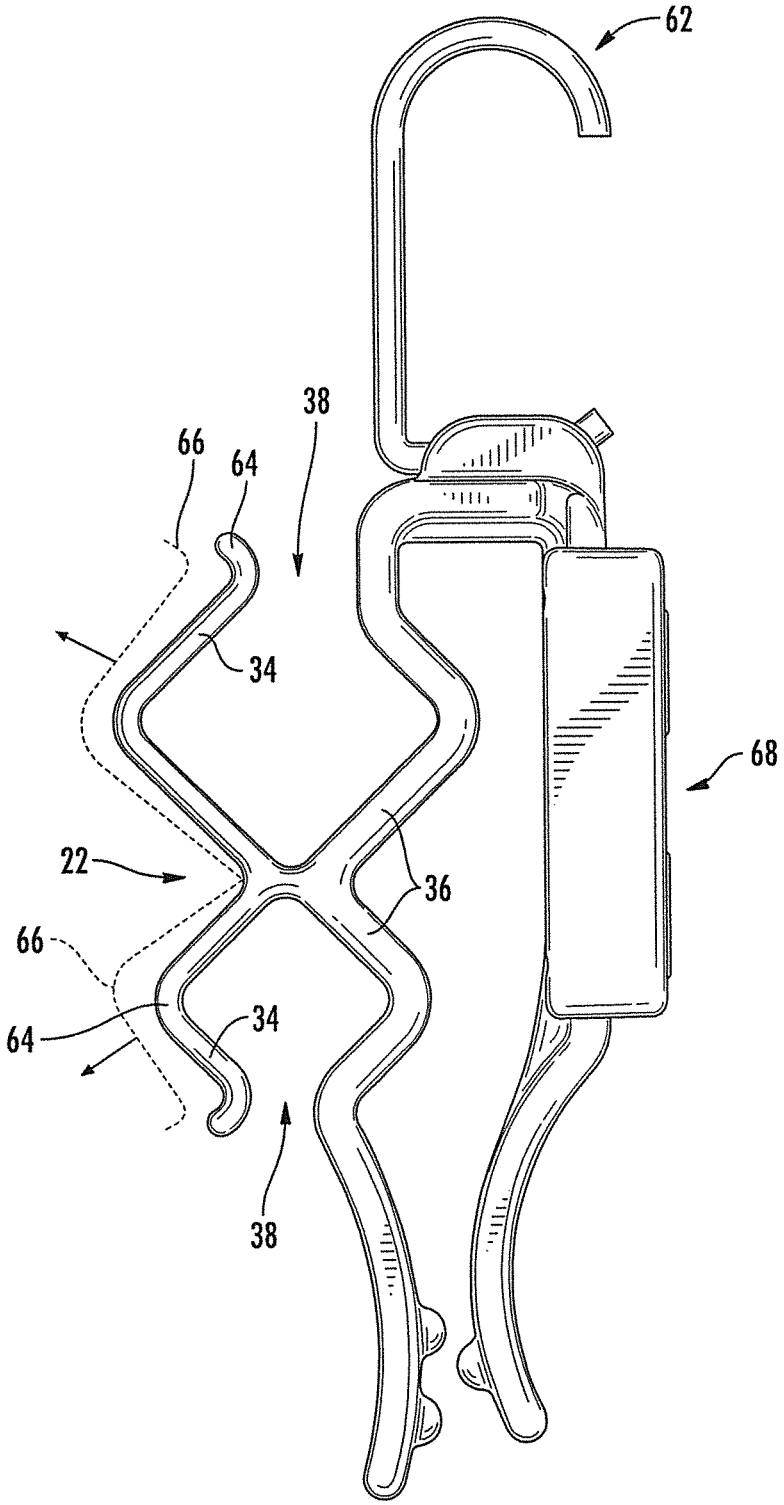
FIG. 6 is side view of the invention illustrated in FIG. 1-5, wherein dimensional variations are further illustrated by dotted lines.

As illustrated in FIG. 6, by way of example, the first and second segments 34, 36 are memory-retentive in that when flexed out of their home position 64, as depicted in dashed lines 66, have an inherent spring bias to return to their home position 64. This spring bias causes the clipping portion 18 to grip a grippable surface tightly, as illustrated by FIG. 2.

The mounting portion 22 is also formed from a memory retentive polymeric material so that the mounting portion will firmly grasp the object 12 and prevent the object 12, such as a flashlight from moving relative to the mounting portion 22. To this end, the mounting portion 22 may also be coated with a rubber-like or soft plastic material to increase friction on appropriate surfaces grasping.

Again, the first and second segments 34, 36 as depicted in FIGS. 1 and 6 are able to flex, so to permit the opening 38 to receive the objects 12, 14, such as the flashlights. The memory retentive upper and lower segments 34, 36 then returning to the home position 64 to firmly grasp the flashlight and retain the flashlight in engagement with the clip 10.

By way of example with reference to FIG. 2, one of ordinary skill in the art will note that the size of the clipping portion 18 is substantially the same width as the mounting portion 22. This width, being the transverse dimension, is preferably between about one-half inch and about three inches. A preferred embodiment would have this width dimension at about three-quarters of an inch, which would change the relative appearance of the mounting clip, for in that size range the transverse dimension would be substantially smaller than the length. The clipping portion 18 is not required to have the same width dimension as the mounting portion 22. A larger width for the mounting portion 22 can provide enhanced engagement between the segments 34, 36 and the objects 12, 14 by way of example. The bill on the front of the cap of FIG. 2 is illustrated by way of example only. In use, it is expected that a flashlight will be placed into the mounting portion by spreading the segments 34, 36 apart to slide the flashlight through the opening to allow the barrel of the flashlight to be positioned within the grasping portion 22. Alternative methods will come to mind for the alternate embodiments herein described. Accordingly, the use of the clip 10 to mount a flashlight or flashlights on the bill of the cap, a belt worn by a user, or the like, allows for deployment of the flashlight aligned generally with the eyes of the user without requiring either of the user's hands to be utilized to manipulate the flashlight.

Figure 7:
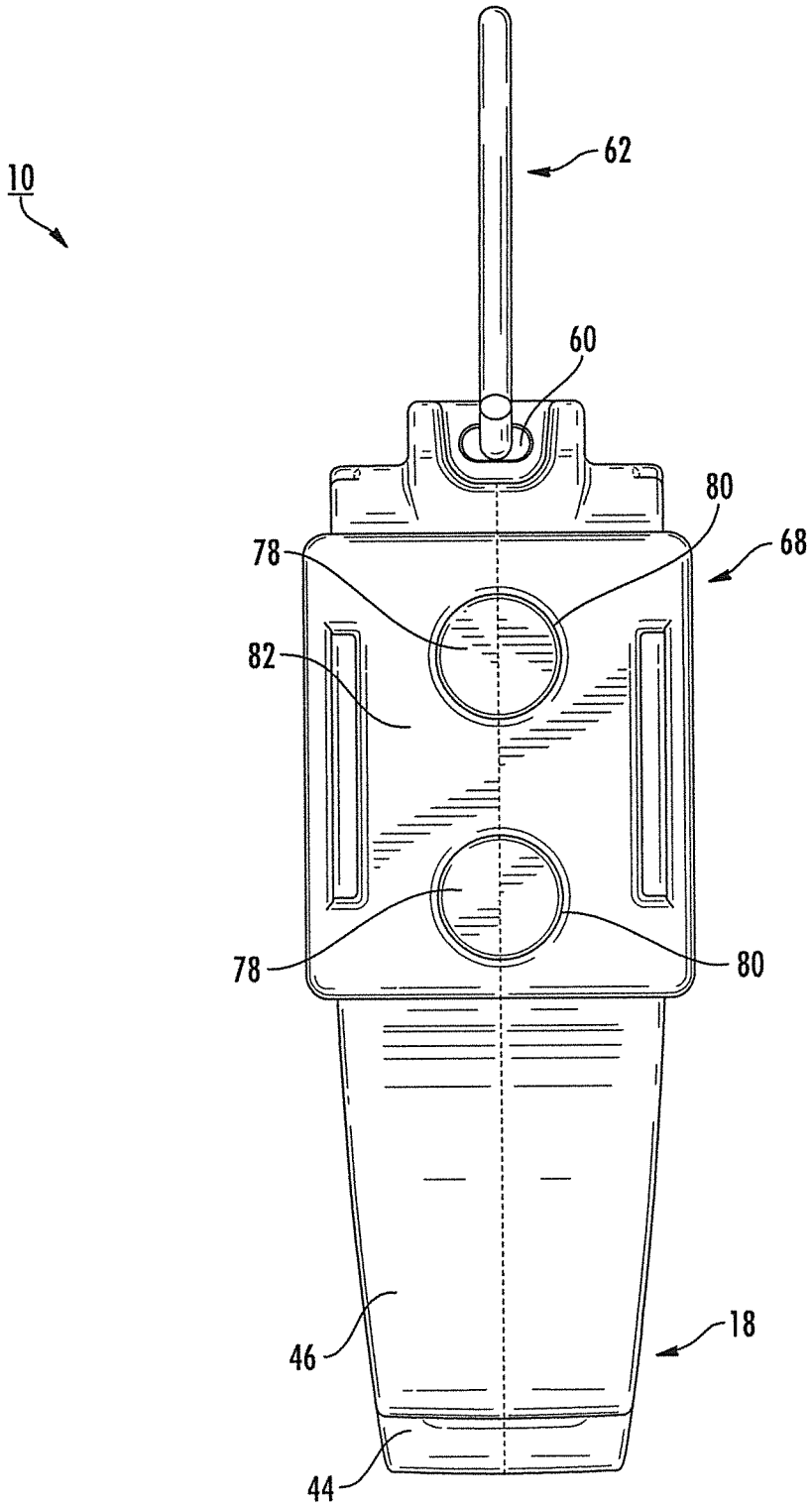
FIG. 7 is bottom view of the invention illustrated in FIG. 1-6.
Figure 8:
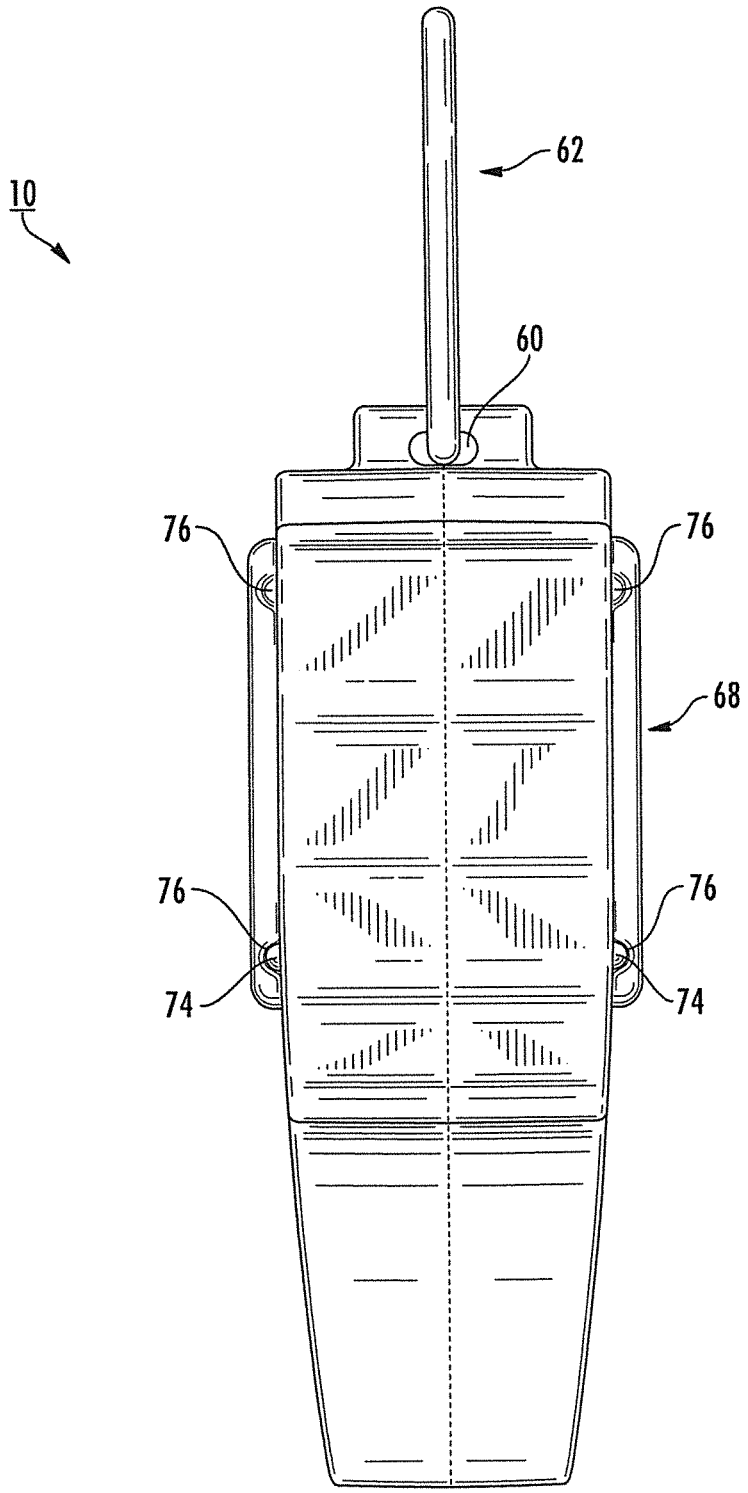
FIG. 8 is top view of the invention illustrated in FIG. 1-7.

With continuing reference to FIG. 5 and now also to FIG. 7, in one embodiment, the clip 10 comprises a separate hook 62 and a magnetic slide 68. Two grooves 70 are molded into the slide 68 for the purpose of engaging edges 72 of the clip. The edges 72 each have a detent 74 that engage corresponding indentations 76 in the slide 68 for the purpose of securely, yet removably, attaching the slide 68 to the clip 10. A magnet 78 is attached to the slide 68. In one embodiment, a pocket 80 is molded into the slide 68 to encase the magnet 78. A pocket is of a size and dimension to secure a magnet 78 using pressure, adhesive, both adhesive and pressure, or any other attachment means known in the art. The magnet 78 is, in one embodiment, substantially flush with the bottom surface 82 of the slide 68. In another embodiment, the magnet 78 protrudes beyond the bottom surface 82 of the slide 68.

The slide 68 provides a means of adapting the clip 10 to be magnetically attachable to a ferrous surface. The surface can be, for example, without limitation, a wall, metal tabletop or bottom, toolbox, refrigerator door, and metal automobile surfaces.

Figure 9:
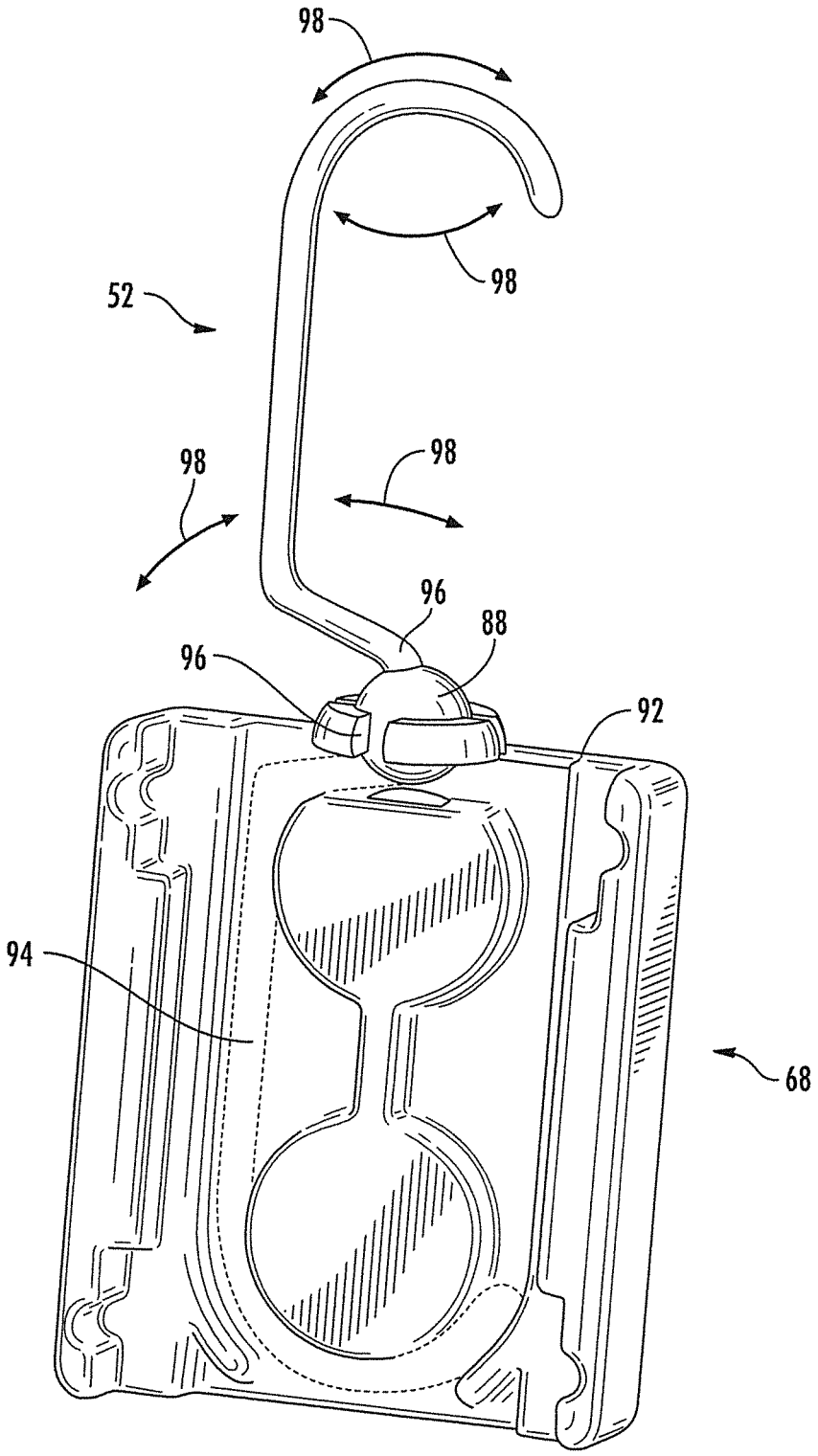
FIG. 9 is a perspective view of an alternate embodiment of the slide.
Figure 10:
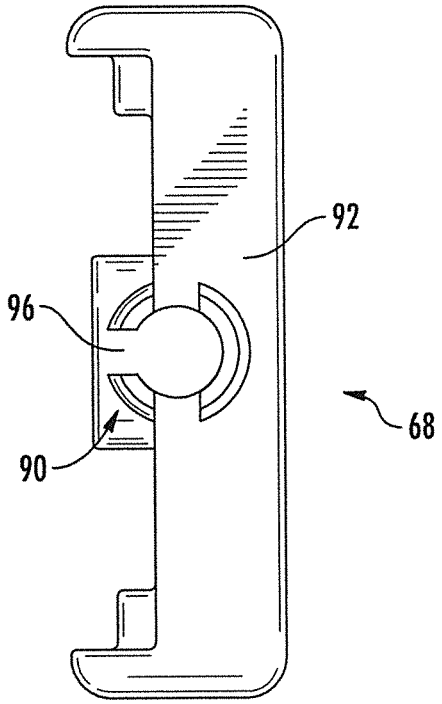
FIG. 10 is top view of the slide of FIG. 9 without the hook installed in the slide.
Figure 11:
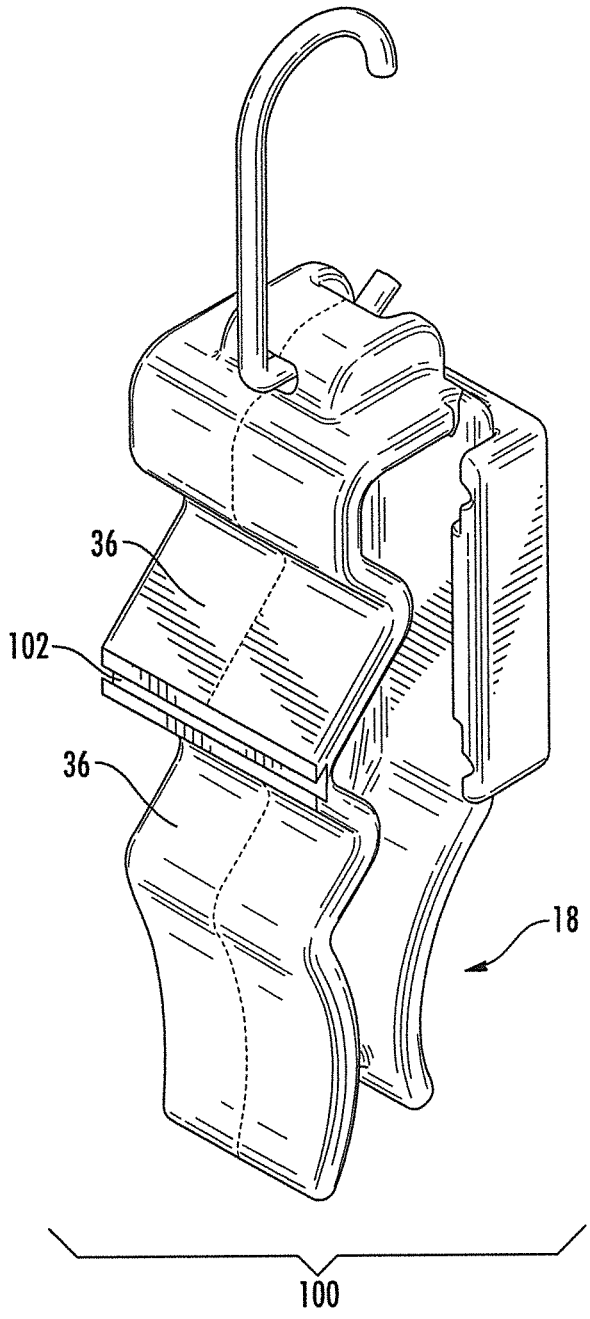
FIG. 11 is perspective view of one embodiment of the clip having an accessory slot.

FIGS. 9 and 10 illustrate an alternative embodiment of the slide 68 wherein the hook 62 does not separate from the slide 68 during normal use. The hook 62 comprises a terminal ball 88 that fits within a socket 90 forming a ball and socket swivel joint. The socket 90 is attached to a top edge 92 of the slide 68, and is preferably molded as part of the slide 68. The hook 62 is stored in a hook channel 94 when not in use, which is illustrated in FIG. 9 by the dashed outline indicating hoop placement within the hook channel 94. In the stored position, the neck of the hook 96 passes through an opening 96 defined by the socket 90, the opening 96 having a size and dimension to allow the hook to swivel to a point where the neck occupies the opening.

With continuing reference to FIG. 9, it is illustrated by the series of arrows 98 that when the hook 62 is in a non-stored position that the ball and socket joint 88/90 permits the hook to spin 360° around the axis of the neck 96. Additionally, the hook 68 swivels with a range of at least 70° (measured at the neck 96) and maintains this range in any direction, 360° around the socket 90. By integrating the hook 62 into the slide 68, the magnet 78 of the slide is capable of being attached to an object, and that object can now be hung by the hook 62. Alternatively, the magnet 78 may be used to attach the slide 68 to a ferrous surface so that the hook 62 is used to hang an object from the surface.

FIGS. 11 to 14 illustrate an embodiment of the invention wherein a clip body 100 comprises a clipping portion 18 that is a separate construction from the mounting portion 22. The body 100 comprises an accessory slot 102 situated between the gripping segments 36. The slot 102 is oriented generally orthogonally to the long axis of the clip body 100. The slot 102 is preferably a dovetail-shaped slot, but any shape slot known in the industry that is capable of receiving and securing a mating projection is contemplated. Accessories having mating projections fit into the slot.

Figure 12:
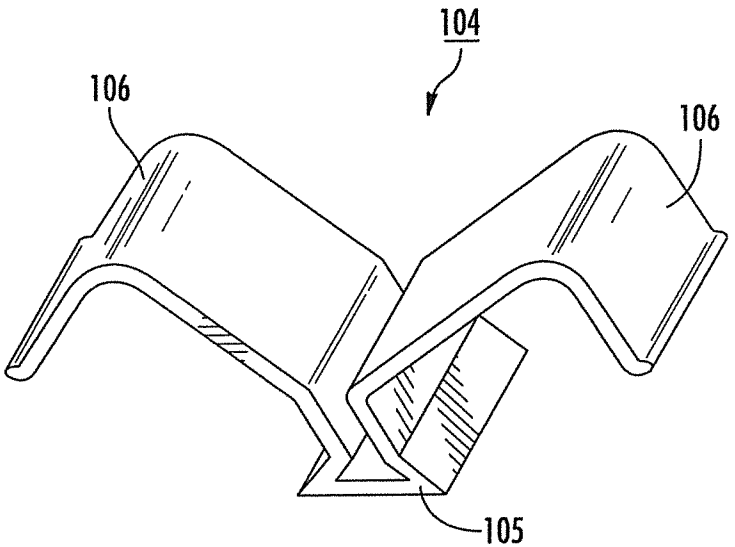
FIG. 12 is a perspective view of one embodiment of an object mounting accessory compatible with the clip of FIG. 11.

FIG. 12 illustrates a first accessory object mounting portion 104. The first accessory object mounting portion 104 comprises a mating projection region 105 that communicates with the accessory slot 102, and provides the means to securely attach the first accessory object mounting portion 104 onto the clip body 100. The first accessory object mounting portion 104 comprises opposing segments 106 that are biased toward the gripping segments 36 of the clip body 100 when attached to the clip body 100. The first accessory object mounting portion 104 is dimensioned to allow an object to be secured between the opposing segments 106 and the clip body 100. The opposing segments 106 can flex sufficiently away from the clip body 100 to maintain pressure on objects secured by the opposing means 106.

Figure 13:
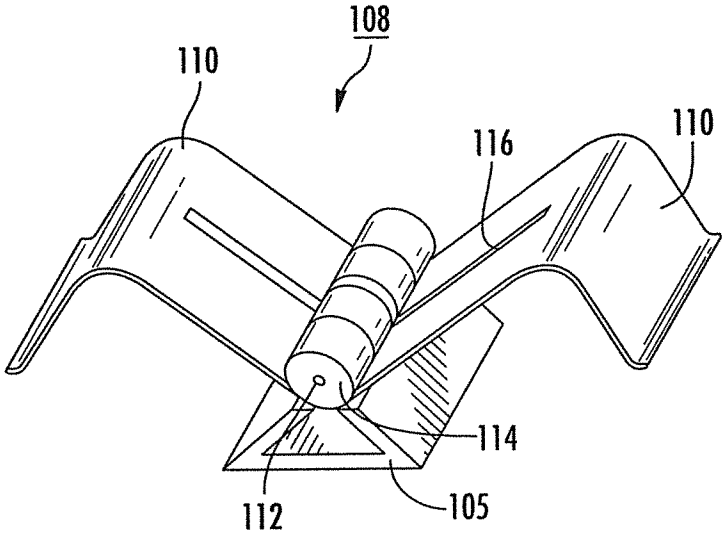
FIG. 13 is a perspective view of a second embodiment of an object mounting accessory compatible with the clip of FIG. 11.

FIG. 13 illustrates a second accessory object mounting portion 108. The second accessory object mounting portion 108 comprises a mating projection region 105 that communicates with the accessory slot 102, and provides the means to securely attach the second accessory object mounting portion 108 onto the clip body 100. The second accessory object mounting portion 108 comprises hinged gripping segments 110 that are biased toward the clip body 100 when attached to the clip body 100. The hinged segments 110 engage a pin 112 that comprises the fulcrum upon which the hinged segments 110 can travel. The pin 112 also attaches the hinged segments to a base 114. A spring 116 communicates with the base 114 and the hinged segments 110, and exerts pressure upon the hinged segments 110 so that they can, when installed in the clip body 100, engage and secure an object between the hinged segments 110 and the clip body 100.

Figure 14:
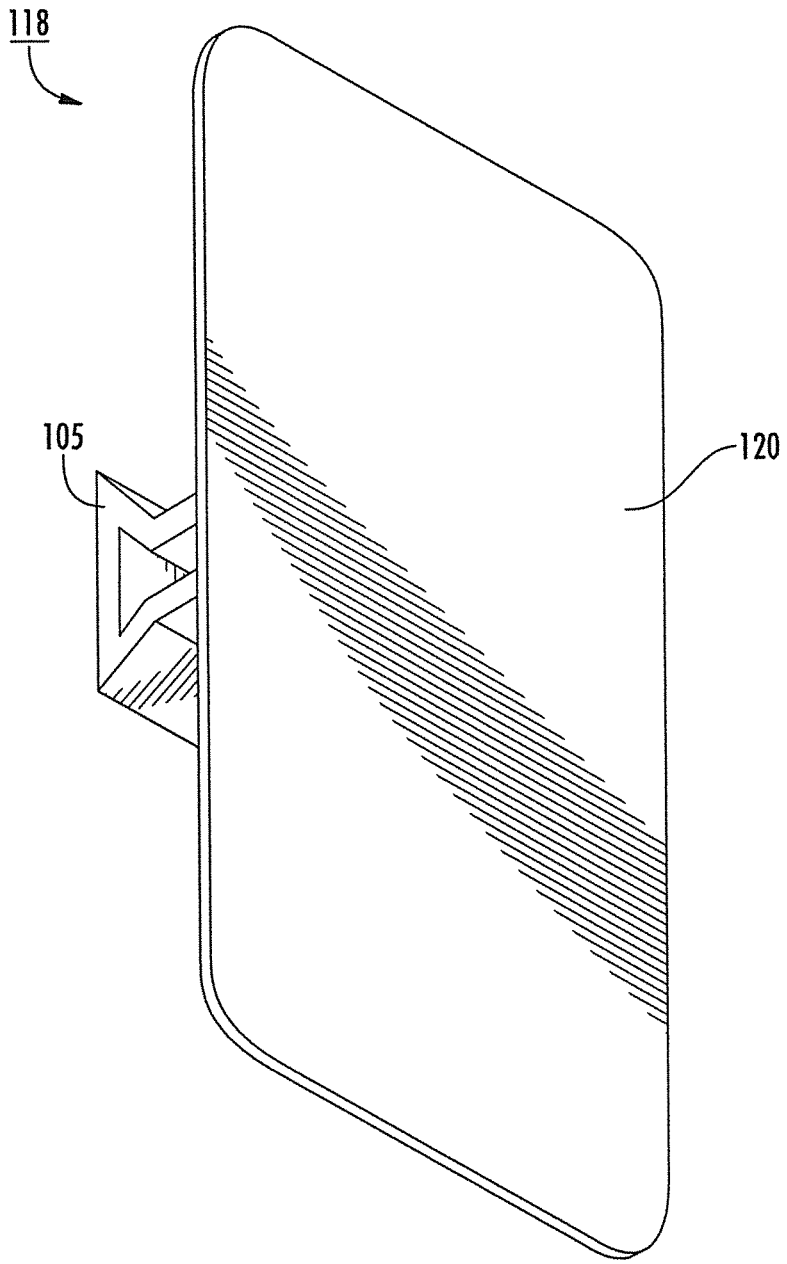
FIG. 14 is a perspective view of a base accessory compatible with the clip of FIG. 11.

FIG. 14 illustrates an accessory mount 118. This mount 118 provides a platform 120 to which objects can be attached. The mount 118 comprises a mating projection region 105 that communicates with the accessory slot 102, and provides the means to securely attach the mount 118 onto the clip body 100. The mount 118 provides a means to attach an object, such as a cell phone, or any other object capable of being adhered to the platform 120, to the clip body 100.

Method of Use

The invention contemplates methods to use the clip 10. With reference to FIG. 2, the clip 10 is used to attach at least one flashlight to a surface capable of being clipped onto by the clipping portion 18. An example of such a surface is a hat bill, a belt, or a pants waist line.

Figure 15:
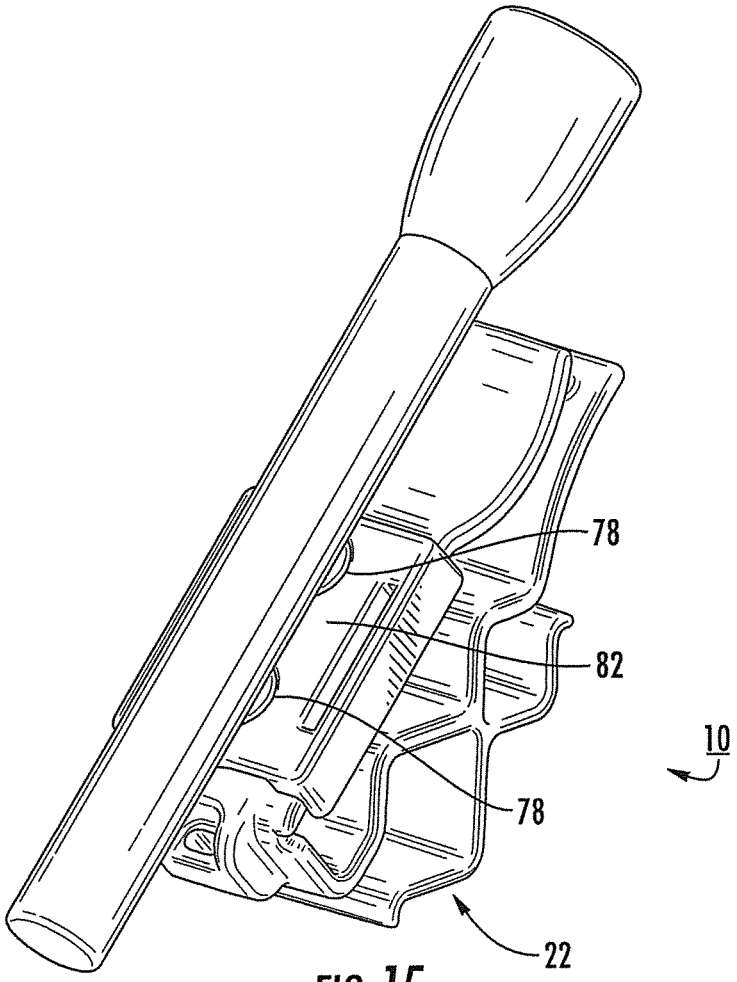
FIG. 15 is a perspective view of one embodiment of the invention illustrating the upward aiming of a flashlight magnetically attached to the clip.
Figure 16:
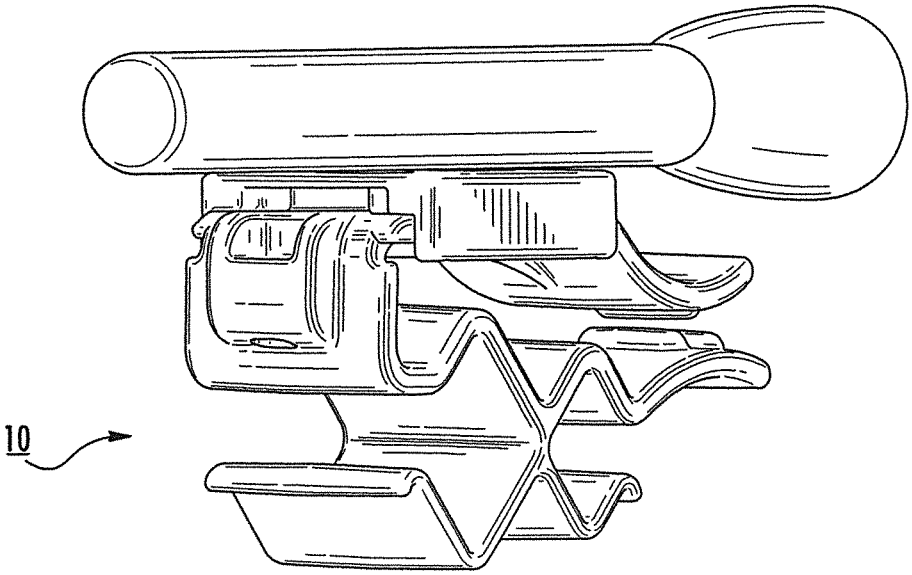
FIG. 16 is a perspective view of one embodiment of the invention illustrating the aiming of a flashlight magnetically attached to the clip.

The invention also contemplates, as illustrated by FIG. 15 and 16, a method of aiming a flashlight by using the clip 10 as a base. FIG. 15 illustrates magnetically attaching a flashlight to the magnets 78, and adjusting the position of the flashlight with relation to the magnets 78 so that the object mounting portion 22 contacts a surface so the flashlight is aimed away from the surface at between about a 30 ° and 85° angle. FIG. 16 similarly illustrates magnetically attaching a flashlight to the magnets 78, and adjusting the position of the flashlight with relation to the magnets 78 so that the object mounting portion 22 contacts a surface so the flashlight is aimed towards the surface or approximately parallel with the plane of the surface. A different range of angles is available to the user by merely changing the orientation of the flashlight 180 ° on the magnets.

Figure 17:
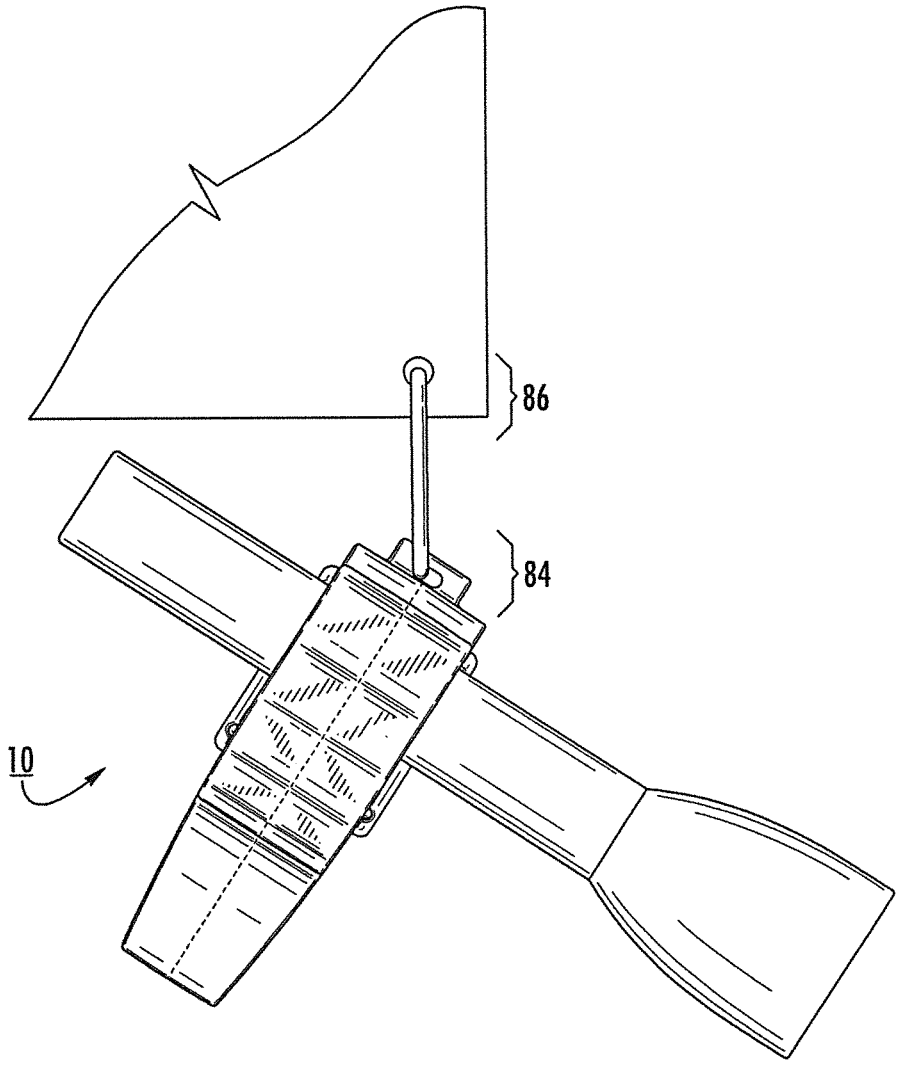
FIG. 17 is a top view of one embodiment of the invention illustrating the clip being hung from a surface and a flashlight engaged by the object engaging portion of the clip.

As illustrated in FIG. 17, the clip 10 may be hung from a location capable of engaging the hook 62. The hook 62 comprises a clip-engaging region 84 that communicates with the hook 62 and surface-engaging region 86 capable of concurrently engaging a hookable surface.

By attaching a flashlight to the object mounting portion 22 and adjusting the position of the flashlight with relation to the magnets 78 the balance is altered and the angle of the flashlight is changed so that the flashlight aims in a different direction. The angle is adjusted by changing the position of the flashlight within the mounting portion 22. The flashlight or other similarly sized ferrous object can alternatively be held with the magnets 78.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the claims herein presented.

That which is claimed is:

1. A clip for attaching objects to an article, the clip comprising:

a clipping portion having opposed upper and lower members, the members having opposing surfaces defining a slot therebetween for receiving an article, the clipping portion dimensioned for frictionally attaching to an article;

an object mounting portion formed with the clipping portion, wherein the clipping portion is oriented in a first direction and the object mounting portion is oriented so that an object having an elongate portion has the elongate portion extending generally orthogonally with respect to the first direction when the object is secured by the object mounting portion;

a magnet with the clipping portion; and grasping means with the object mounting portion for removably and snugly grasping objects of different width dimensions, wherein a segment of the grasping means comprises a portion of the upper member of the clipping portion, wherein the grasping means comprises a first opposing segment of the object mounting portion, wherein the first opposing segment is biased toward the clipping portion so as to exert a gripping force on an object carried therebetween.

2. The clip recited in claim 1, further comprising an aperture proximate the clipping portion, the aperture having a size and dimension to receive a removable hook.

3. The clip recited in claim 2, further comprising a removable hook having a clip-engaging region and a surface-engaging region, the hook having a size and dimension to engage the aperture with the clip-engaging region and concurrently engage a hookable surface with the surface-engaging region.

4. The clip recited in claim 1, wherein the magnet is removable.

5. The clip recited in claim 1, wherein the first opposing segment is dimensioned to form an opening between itself and the clipping portion, wherein at least one of the first opposing segment and clipping portion can flex sufficiently away from the other to expand the size of the opening for permitting the object to access the grasping means through the expanded opening.

6. The clip recited in claim 1, wherein the grasping means further comprises a second opposing segment of the object mounting portion, wherein the second opposing segment is biased toward the clipping portion so as to exert a gripping force on an object carried therebetween.

7. The clip recited in claim 6, wherein the second opposing segment is dimensioned to form an opening between itself and the clipping portion, wherein at least one of the second opposing segment and clipping portion can flex sufficiently away from the other to expand the size of the opening for permitting the object to access the grasping means through the expanded opening.

8. The clip recited in claim 7, wherein the first opposing segment has different dimensions from the second opposing segment corresponding to respective dimensions of different objects.

9. The clip recited in claim 8, wherein the different objects comprise first and second flashlights, and wherein the first flashlight comprises a first diameter different from a second diameter of the second flashlight.

10. The clip recited in claim 1, wherein the first opposing segment comprises an arcuate portion.

11. The clip recited in claim 1, wherein the first opposing segment comprises an angled portion.

12. The clip recited in claim 1, wherein an opposing surface comprises an arcuate portion.

13. The clip recited in claim 1, wherein the opposing surfaces comprise a convex surface opposing a concave surface.

14. The clip recited in claim 1, wherein the upper and lower members define an outwardly flaring lip portion that for increasing an entrance dimension to the slot.

15. A method of using the clip of claim 1 to aim a flashlight, comprising the steps of:

attaching the flashlight to the magnet;

positioning the object mounting portion to rest on a surface; and positioning the flashlight at an angle so that when the flashlight is on, light emitted from the flashlight illuminates a target.

16. The method of claim 15 wherein the angle is between about 0 degrees and 65 degrees.

17. A clip for attaching objects to an article, the clip comprising:

a clipping portion dimensioned for removably attaching the clip to an article;

an object mounting portion attached to the clipping portion, wherein the clipping portion is oriented in a first direction and the object mounting portion is oriented so that an object having an elongate portion has the elongate portion extending generally orthogonally with respect to the first direction when the object is secured by the object mounting portion;

a slide that removably engages the clipping portion;

a magnet attached to the slide;

means with the object mounting portion for removably and snugly grasping objects of different width dimensions within the object mounting portion; and a removable hook having a clip-engaging region and a surface-engaging region, the hook having a size and dimension to engage the aperture with the clip-engaging region and concurrently engage a hookable surface with the surface-engaging region;

wherein the surface-engaging region is generally an arcuate shape and the clip-engaging region is generally straight; and wherein:

the clip-engaging region of the hook comprises an obtusely angled terminus; and the aperture is an oblate shape of a size and dimension so that passage of the hook terminus through the apertures is only possible when the hook terminus is substantially aligned with an equatorial diameter of the aperture.

18. The clip recited in claim 17, further comprising a hanging region being defined by an aperture proximate the clipping portion, the aperture having a size and dimension to receive the removable hook.

19. The clip recited in claim 17, wherein:

the slide comprises a recess of a size and dimension to capture and store the hook between the slide and the clipping portion;

the hook is made of a ferrous material; and the magnet provides a securing force to removably attach the hook in the recess.

20. The clip recited in claim 17, wherein a detent molded on the clipping portion engages the slide for removably securing the slide to the clipping portion.

21. A clip for attaching objects to an article, the clip comprising:

a clipping portion dimensioned for removably attaching the clip to an article;

an object mounting portion attached to the clipping portion, wherein the clipping portion is oriented in a first direction and the object mounting portion is oriented so that an object having an elongate portion has the elongate portion extending generally orthogonally with respect to the first direction when the object is secured by the object mounting portion;

a slide that removably engages the clipping portion;

a magnet attached to the slide;

means with the object mounting portion for removably and snugly grasping objects of different width dimensions within the object mounting portion; and wherein the grasping means comprises a first opposing segment of the object mounting portion biased toward the clipping portion so as to exert a gripping force on an object carried therebetween.

22. The clip recited in claim 21, wherein the first opposing segment is dimensioned to form an opening between itself and the clipping portion, wherein at least one of the first opposing segment and clipping portion can flex sufficiently away from the other to expand the size of the opening for permitting the object to access the grasping means through the expanded opening.

23. The clip recited in claim 21, wherein the grasping means further comprises a second opposing segment of the object mounting portion biased toward the clipping portion so as to exert a gripping force on an object carried therebetween.

24. The clip recited in claim 23, wherein the second opposing segment is dimensioned to form an opening between itself and the clipping portion, wherein at least one of the second opposing segment and clipping portion can flex sufficiently away from the other to expand the size of the opening for permitting the object to access the grasping means through the expanded opening.

25. The clip recited in claim 23, wherein the first opposing segment has different dimensions from the second opposing segment corresponding to respective dimensions of different objects.

26. A clip for attaching objects to an article, the clip comprising:

a clipping portion having an upper member and a lower member having opposing surfaces defining a slot therebetween for receiving an article, the clipping portion dimensioned for frictionally attaching to an article;

an object mounting portion attached to the clipping portion, wherein the clipping portion is oriented in a first direction and the object mounting portion is oriented so that an object having an elongate portion has the elongate portion extending generally orthogonally with respect to the first direction when the object is secured by the object mounting portion;

a hanging region defining an aperture proximate the clipping portion, the aperture having a size and dimension to receive a removable hook that hangs the clip;

a removable hook comprising a clip-engaging region and a surface-engaging region, the hook having a size and dimension to engage the aperture with the clip-engaging region and concurrently engage a hookable surface with the surface-engaging region;

a slide that removably engages the clipping portion, the slide comprising a recess having a size and dimension to capture and store the removable hook between the slide and the clipping portion;

a detent molded on the clipping portion that engages the slide to removably secure the slide to the clipping portion;

a magnet attached to the slide for the purpose of attaching the clip to a ferrous surface; and grasping means with the object mounting portion for removably and snugly grasping objects of different width dimensions, wherein a segment of the grasping means comprises a portion of the upper member of the clipping portion, wherein the grasping means comprises a first opposing segment of the object mounting portion, wherein the first opposing segment is biased toward the clipping portion so as to exert a gripping force on an object carried therebetween.

* * * * *